US006662414B1

(12) United States Patent
Niewiadomski

(10) Patent No.: US 6,662,414 B1
(45) Date of Patent: Dec. 16, 2003

(54) BUCKLE

(76) Inventor: Oliver Niewiadomski, Ditmar Koel Strasse 28, D 20459 Hamburg (DE)

( * ) Notice: Subject to any disclaimer, the term of this patent is extended or adjusted under 35 U.S.C. 154(b) by 0 days.

(21) Appl. No.: 10/179,256

(22) Filed: Jun. 26, 2002

(51) Int. Cl.[7] ..... A44B 11/25
(52) U.S. Cl. ..... 24/625
(58) Field of Search ..... 24/614–616, 625

(56) References Cited

U.S. PATENT DOCUMENTS 3,979,934 A * 9/1976 Isenmann ..... 70/459
5,291,641 A * 3/1994 Morino ..... 24/625
5,465,472 A * 11/1995 Matoba ..... 24/625
6,421,889 B1 * 7/2002 Chien ..... 24/614
6,460,232 B2 * 10/2002 Maruoka ..... 24/615

FOREIGN PATENT DOCUMENTS

EP 95656 A * 12/1983 ..... A44B/11/25

* cited by examiner

*Primary Examiner*—James R. Brittain
(74) *Attorney, Agent, or Firm*—Myron Amer PC

(57) ABSTRACT

A plastic buckle having a male plug with a respectively downwardly and an upwardly flexing pair of arms which snap into place within recesses in a female socket during the insertion of the male plug within the female socket, during which insertion guides on the female socket extend into the paths of flexing movement of the male plug arms to both assist in the tracking movement of the male plug within the female socket and also to stop the extent of the flexing movements so as not to exceed a limit which would cause breakage of the plastic construction material of the male plug arms.

1 Claim, 2 Drawing Sheets

BUCKLE

The present invention relates generally to improvements in male and female components of a buckle, the improvements more particularly obviating flexuring movements required in the interconnecting of the male and female component from occurring to an extent which causes, over time, a rupture of the plastic construction material of the buckle partaking of the flexuring movements.

EXAMPLE OF THE PRIOR ART

A buckle of the nature involved is exemplified by the buckle of U.S. Pat. No. 6,263,549 issued for "BUCKLE WITH REINFORCING RIDGE AND GROOVE" to Ryoichiro Vehara on Jul. 24, 2201. The operating mode of the '549 buckle and all other known similarly functioning buckles contemplate the use of flexuring plastic construction material to allow traverses in interconnecting structures on male arms or legs in relation to cooperating recesses in the female component to thusly provide the buckling and unbuckling functions, i.e., the seating and unseating of the male and female connectors. While generally useful for the purposes intended, a drawback of these prior art buckles is that the extent of the flexuring transverses is confined within limits that will obviate rupture of the plastic construction material or condition of buckle use that is reasonable, but not if the buckle use is unavoidably excessive or abused by the user. Thus, a flexuring male connection-establishing arm can be strengthened by ribs or the like and thus resist, certainly initially, rupture, but over a duration of time not anticipated, or buckling and unbuckling during this duration of time in a manner also not accounted for in the design of the strength-imparting rib(s), rupture of plastic construction material will render the buckle unusable.

Broadly, it is an object of the present invention to provide a plastic buckle of the nature of the '549 patent overcoming the foregoing and other shortcomings of the prior art.

More particularly, it is an object to restrict the flexuring in the operation of the buckle to a range between a nominal to a maximum extent, the former being only the extent required to unseat the male and female connectors-to provide the unbuckling function, and the latter of an extent that minimizes any rupturing consequence and being the result of an abutment in the path of the flexuring movement and thus not dependent on a time interval or abuse or lack of abuse during use of the buckle, all as will be better understood as the description proceeds.

The description of the invention which follows, together with the accompanying drawings should not be construed as limiting the invention to the example shown and described, because those skilled in the art to which this invention appertains will be able to devise other forms thereof within the ambit of the appended claims.

Figure 1:
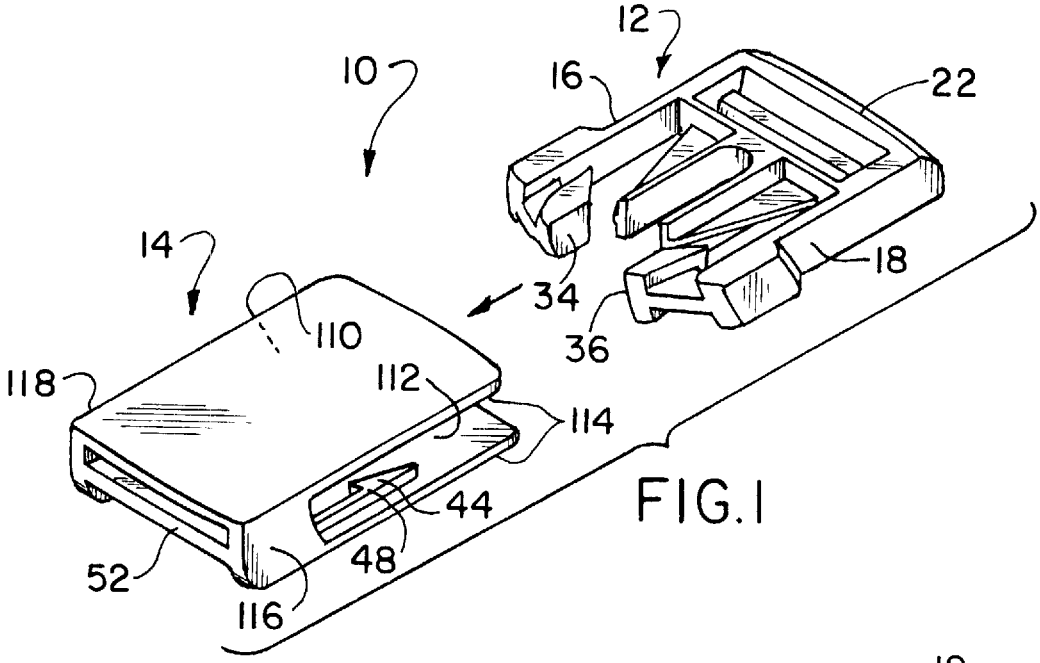
FIG. 1 is an exploded perspective view of male and female components of a buckle according to the present invention.

The drawings illustrate a buckle, generally designated 10, which is an improvement of a known type using an interconnecting male plug member and female socket member, each respectively generally designated 12 and 14, which in use form a closed loop (not shown) of length portions of straps or flaps interconnected by the buckle 10. A common example of this end use is a safety belt for the driver and passengers of a vehicle or that similarly used for a seated passenger on an airplane.

The male plug 12 includes a pair of outboard first 16 and second 18 legs or arms of flexuring construction material each extending from sites of attachment, as noted at 20, from a base 22 of the male plug 12 so as to extend in cantilever relation forwardly a selected distance, as noted at 24, and terminating in free ends 26 and 28. The distance 24 is of a selected extent to be projected within the confines of the female socket 14 and, to be noted the legs 16 and 18 bound an appropriate width 30 therebetween to also be accommodated within the female socket 14, and any adjustments in this width 30 for this positioning of the male plug 12 within the female socket 14 is readily achieved by flexuring movements 32 of the legs free ends 26, 28, which movements 32 also facilitate the interconnecting and disengaging of the male plug 12 and female socket 14 from each other, all as will be better understood as the description proceeds.

The leg free ends 26 and 28 have a connection-establishing shaped configuration 34 and 36, both soon to be described in more detail, which it is important to note are offset from a cooperating leg 16 and 18, the leg configuration 34 being in depending relation, as noted at 38, from the upper leg 16 and the leg configuration 36 being in an ascending relation, as noted at 40, from the lower leg 18.

Cooperating with the connection-establishing configurations 34 and 36 are first 42 and second 44 connection-establishing members on the female socket 14 at locations, noted at 46 and 48, which are adjacently outwardly of a distance 50 from a base 52 of the female socket 14 and along a path of movement 54 imparted by manual insertion of the male plug 12 within the female socket 14. During movement 54, an angled surface 56 on each male plug configurations 34, 36 slip past an edge 58 and 60 of a recessed shoulder 62, 64 of the connection-establishing members 42, 44, and interengage one with the other, at sites of engagement, as noted at 66 and 68. Just prior to the engagement sites 66 and 68, contact is made with angled surfaces 70 and 72 on the engagement-establishing members 42 and 44 and this contact produces a camming action in the direction of the surface angle in a depending direction for the leg configuration 34 and in an ascending direction for the leg configuration 36, which are directional movements as permitted by the flexuring construction material of the legs 16 and 18. Once past the edges 58 and 60, an urgency of the flexuring construction material reverses the directional movements of the engagement-establishing configurations 34 and 36, and effectively seats the configurations in the shoulder recesses 62 and 64.

Completing the construction of the male plug 12 and female socket 14 are tracking guides, one such guide 78 consisting of adjacent extensions 80 and 82 extending from the base 52 of the female socket 14, and a cooperating guide 84 consisting of adjacent extensions 86 and 88 extending from the base 22 of the male plug 12, the width 90 between the extensions 86 and 88 being sized to slip about tracking guide 78.

The directional disengaging movements 98 and 100 of the male plug legs 16 and 18 from the female socket shoulder recesses 62 and 64 is to be understood to be of a nominal extent, say 3/16 of an inch, well within the flexuring capacity of the leg construction material without rupturing or causing a failure of the construction material. This is assured to a significant extent by embodying an upper and lower push button 104 and 106 of a height 108 on the legs 16 and 18, which buttons 104, 106 are respectively raised and lowered by the urgency of the leg construction material through access slots 110 and 112, each bounded by edges, individually and collectively designated 114, in opposite sides 116 and 118 of the female socket 14. Thus the height size 108 limits the extent to which the free ends 26 and 28 will downwardly traverse or flexure.

However, during handling of the male plug 12 preparatory to insertion into the female socket 14, it has been: found in practice that a user might inadvertently press the buttons 104, 106 in closing movement 120 which, being unrestrained in prior art buckles, is of an extent which exceeds the flexuring capacity of the construction material of the legs 16, 18 and thus causes a rupturing of a leg 16, 18 of the male plug 12. This is a significant prior art shortcoming particularly because of the repetitious buckling of the male plug 12 within the female socket 14 and the progressive weakening of the construction material at the attachment sites 20.

Figure 2:
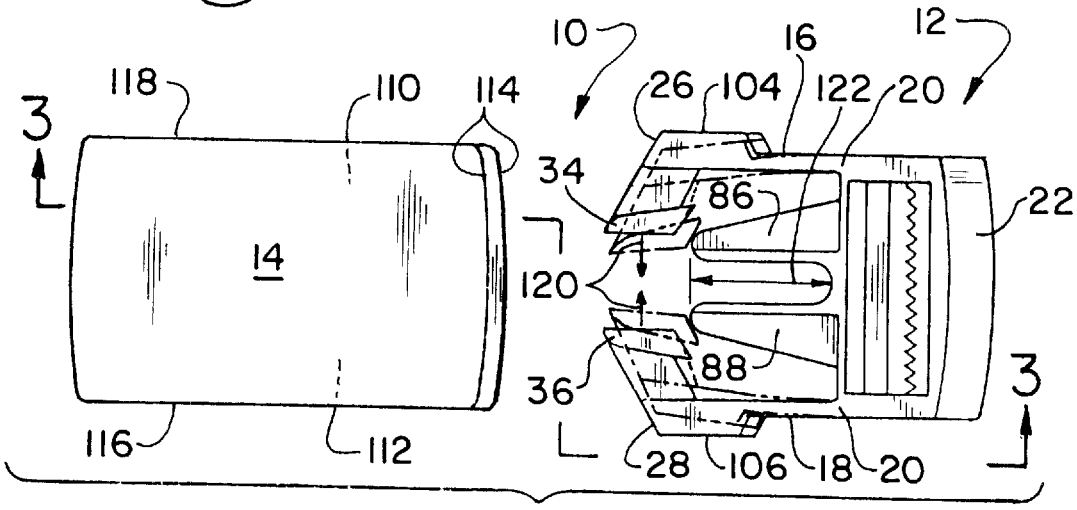
FIG. 2 is a plan view of the components of FIG. 1.
Figure 3:
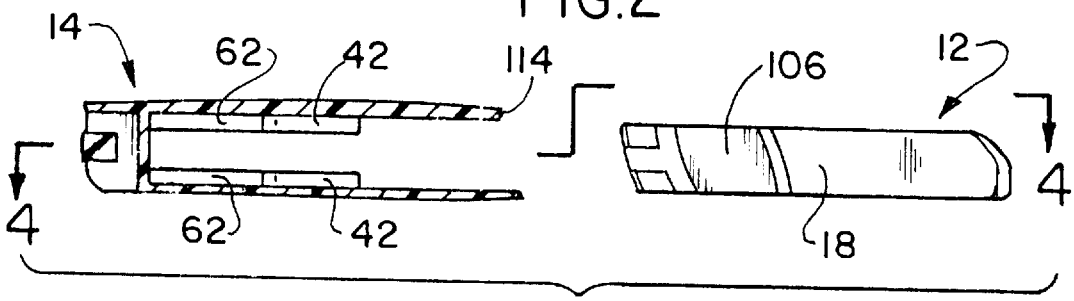
FIG. 3 is a sectional view, in cross section, as taken along line 3—3 of FIG. 2.
Figure 4:
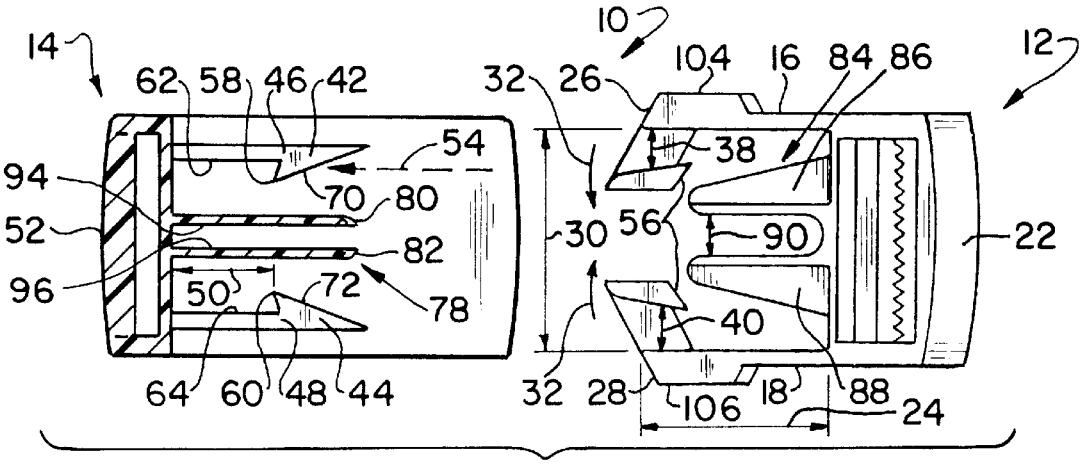
FIG. 4 is a sectional view, in cross section, as taken along line 4—4 of FIG. 3.
Figure 5:
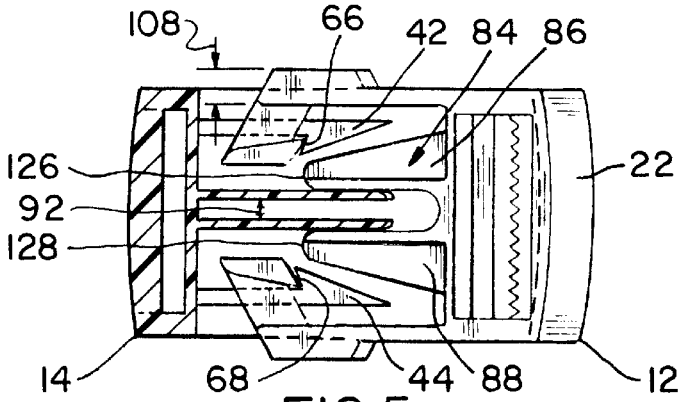
FIG. 5 is a view similar to FIG. 2, but of the components of FIG. 2 in assembled condition.
Figure 6:
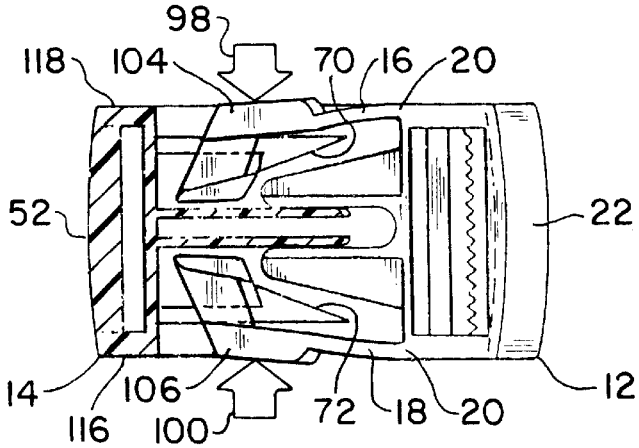
FIG. 6 is another view similar to FIG. 2, but illustrating the components of FIG. 2 about to be disassembled.

To obviate breakage or rupture of the legs 16, 18, the forward extending distance 122 of the tracking extensions 86, 88 is selected to advantageously position each end 26, 28 in the path of the closing movement 120 of the surfaces 56 and, as a result, the track ends 126, 128 effectively serve as stops, as noted in phantom in FIG. 2, limiting the closing movement 120 to traverses well within the restrained extents as when the buttons 104, 106 are used in unbuckling the male plug 12 from the female socket 14.

While the buckle, as well as the method of use thereof as shown and disclosed in detail, is fully capable of attaining the objects and providing the advantages hereinbefore stated, it is to be understood that it is merely illustrative of the presently preferred embodiment of the invention and that no limitations are intended to the detail of construction or design herein shown other than as defined in the appended claims.

What is claimed is:

1. A buckle comprising an interconnecting male plug and female socket, a pair of outboard first and second arms of flexuring construction material extending from sites of attachment in cantilever relation from said male plug having free ends each at a distal location thereon, a pair of first and second connection-establishing members mounted on said male plug arms distal locations characterized by said mounting being offset in depending relation from said first arm and in ascending relation from said second arm so that said first and second connection-establishing members extend inwardly toward each other, cooperating first and second connection-establishing members on said female socket disposed adjacently outwardly of and along a path of movement of said first and second male plug connection-establishing members incident to establishing and undoing the establishing of a connection therebetween as allowed by a selected extent of inner flexuring movement of said male plug arms, a first pair of spaced apart tracking guides extending from sites of attachment in cantilever relation from said female plug, a second pair of spaced apart tracking guides extending from sites of attachment in cantilever relation from said male plug, said first and second pairs of tracking guides being adapted upon projected movement of said male plug within said female socket to have free ends thereof assume a telescoped relation with each other, said cantilever length of said second pair of tracking guides being of an extent to locate said free ends thereof in a path of flexuring movement of said male plug free ends so as to limit by abutment the flexuring movement of said male plug free ends to a nominal extent so as to obviate breakage of said male plug first and second arms at said sites of attachment thereof, whereby said second pair of tracking guides serves as a stop limiting the extent of inner flexuring of said male plug arms only to the nominal extent required to do and undo said established connection to said connection-establishing members on said female socket.

* * * * *